United States Patent [19]

Metcalf et al.

[11] Patent Number: 4,786,856

[45] Date of Patent: Nov. 22, 1988

[54] TEMPERATURE COMPENSATED CURRENT SOURCE

[75] Inventors: Michael H. Metcalf; Stewart S. Taylor, both of Beaverton, Oreg.

[73] Assignee: Tektronix, Inc., Beaverton, Oreg.

[21] Appl. No.: 195,385

[22] Filed: May 10, 1988

Related U.S. Application Data

[63] Continuation of Ser. No. 3,526, Mar. 12, 1987, abandoned.

[51] Int. Cl.[4] ..... G05F 3/26

[52] U.S. Cl. ..... 323/315; 323/907

[58] Field of Search ..... 323/313, 314, 315, 316, 323/907

[56] References Cited

U.S. PATENT DOCUMENTS

| | | | |
|---|---|---|---|
| 3,544,882 | 12/1970 | Tanaka | 323/315 |
| 3,886,435 | 5/1975 | Steckler | 323/315 |
| 3,922,596 | 11/1975 | Cave et al. | 323/316 |
| 3,925,718 | 12/1975 | Wittlinger | 323/315 |
| 3,956,661 | 5/1976 | Sakamoto et al. | 323/907 X |
| 3,973,215 | 8/1976 | Ahmed | 323/315 |
| 4,461,992 | 7/1984 | Yamaguchi et al. | 323/313 |

*Primary Examiner*—Peter S. Wong

*Attorney, Agent, or Firm*—William S. Lovell; Paul S. Angello

[57] ABSTRACT

A current source provides an output current whose magnitude is substantially independent of changes in temperature. In each of three embodiments (50, 100, 120), one or more bipolar transistors are employed to provide a compensating current which is dependent on the base-to-emitter voltages, $V_{BE}$, of such bipolar transistors. The compensating current changes with temperature so as to offset changes in the uncompensated output current so that the total output current is substantially independent of $V_{BE}$. The three embodiments employ current mirror circuits (10, 122) that provide a current source of simple circuit design that is operable with the use of a single power supply at a relatively low voltage.

12 Claims, 2 Drawing Sheets

TEMPERATURE COMPENSATED CURRENT SOURCE

This is a continuation of application Ser. No. 003,526 filed Mar. 12, 1987 and now abandoned.

TECHNICAL FIELD

The present invention relates to current sources and, in particular, to a method and circuit for stabilizing with changes in temperature the output current developed by a current source.

BACKGROUND OF THE INVENTION

A "current mirror" circuit is one simple form of current source that is typically implemented as an integrated circuit. A current mirror circuit employing bipolar transistors suffers, however, from the disadvantage of providing an output current whose magnitude is uncertain and remains substantially constant over only a relatively narrow range of operating temperatures. The reason is that the output current depends on the base-to-emitter voltage of at least one transistor used in the current mirror circuit whose voltage varies with different integrated circuits and changes in temperature. A current source of this type is, therefore, undesirable for use in applications that require an output current of predictable magnitude or an output current whose magnitude remains constant over a wide range of operating temperatures.

A current source of conventional design which includes a special "bias" operational amplifier provides an output current of constant magnitude that is independent of temperature. This type of current source is undesirable because the operational amplifier employs many transistor devices, which constitute a circuit of complex design that is difficult to implement with a single power supply, particularly at a relatively low voltage (e.g., +5 volts).

SUMMARY OF THE INVENTION

An object of the present invention is, therefore, to provide a current source that is suitable for implementation as an integrated circuit and develops an output current whose magnitude remains constant with changes in temperature.

Another object of the invention is to provide such a current source that is of simple design and is operable with the use of a single power supply at a relatively low voltage.

A further object of the invention is to provide such a current source which is implemented with bipolar transistors but whose output current is independent of the base-to-emitter voltages of such transistors.

Still another object of the invention is to provide in a current source that employs a current mirror circuit, a method for stabilizing the output current with changes in temperature.

Yet another object of the invention is to provide an electrical circuit for implementing such method of stabilizing the output current with bipolar transistors.

Additional objects and advantages of the present invention will be apparent from the following detailed description of preferred embodiments thereof, which proceeds with reference to the accompanying drawings.

DETAILED DESCRIPTION OF PREFERRED EMBODIMENTS

Figure 1:
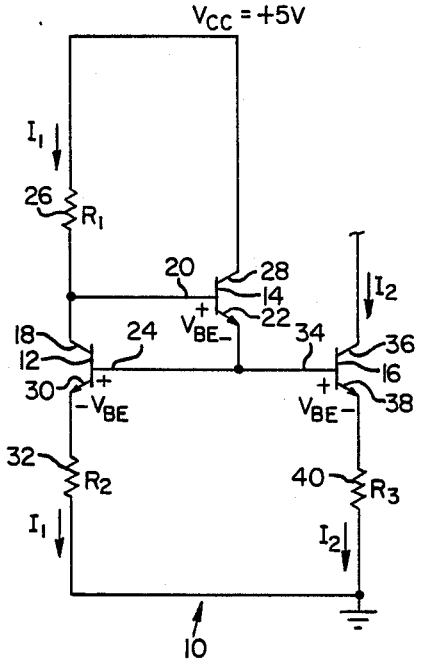
FIG. 1 PRIOR ART
FIG. 1 is an electrical circuit diagram of a prior art current source employing a current mirror circuit.

With reference to FIG. 1, a prior art current source 10 of the current mirror type includes NPN transistors 12, 14, and 16 of essentially identical design. The collector terminal 18 of transistor 12 is connected to the base terminal 20 of transistor 14, and the emitter terminal 22 of transistor 14 is connected to the base terminal 24 of transistor 12. Interconnecting transistors 12 and 14 in this manner forces the collector-to-base voltage of transistor 12 to equal the base-to-emitter voltage, $V_{BE}$, of transistor 14. Collector terminal 18 of transistor 12 is connected through a resistor 26 of value "$R_1$" to a collector bias voltage $V_{CC}=+5$ volts. The collector terminal 28 of transistor 14 is directly connected to $V_{CC}$. The emitter terminal 30 of transistor 12 is connected through a resistor 32 of value "$R_2$" to ground. The reference current $I_1$ flowing through resistor 32 is determined by application of Kirchoff's voltage law and can be expressed as:

$$I_1=V_{CC}/(R_1+R_2)-2V_{BE}/R_1.$$

The above equation is correct under the assumptions that the base-to-emitter voltages of transistors 12 and 14 are equal and that the collector and emitter currents of transistor 12 are equal. The above equation indicates that the current $I_1$ is dependent on the magnitude of $V_{BE}$, the temperature coefficient of which is approximately $-2$ mV/°C.

The emitter terminal 22 of transistor 14 and base terminal 24 of transistor 12 are connected to the base terminal 34 of transistor 16, which provides the output current for current source 10. The output current $I_2$ flows from the collector terminal 36 to the emitter terminal 38 of transistor 16 through a resistor 40 of value "$R_3$" to ground. Collector terminal 36 of transistor 16 which is biased to a voltage of sufficient magnitude to ensure proper operation of transistor 16 can be connected, for example, to an emitter-coupled differential amplifier or the emitter terminal of an emitter-follower transistor. The output current $I_2$ flowing through transistor 16 is determined by application of Kirchoff's voltage law and can be expressed as:

$$I_2=I_1\times R_2/R_3.$$

The above equation is correct under the assumptions that the base-to-emitter voltages of transistors 12 and 16 are equal and that the collector and emitter currents of transistor 6 are equal. The above equation indicates that the output current $I_2$ of current source 10 is directly proportional to the reference current, which is a function of $V_{BE}$. The dependence of the output current $I_2$ on $V_{BE}$ is undesirable because its value varies with changes in temperature and is unpredictable, usually to within 100 mV for different integrated circuits in which current sources of this type are typically incorporated. The output current $I_2$ is, therefore, constant only for operating temperatures within a relatively small range and predictable only to the extent to which the value of $V_{BE}$ is known.

Figure 2:
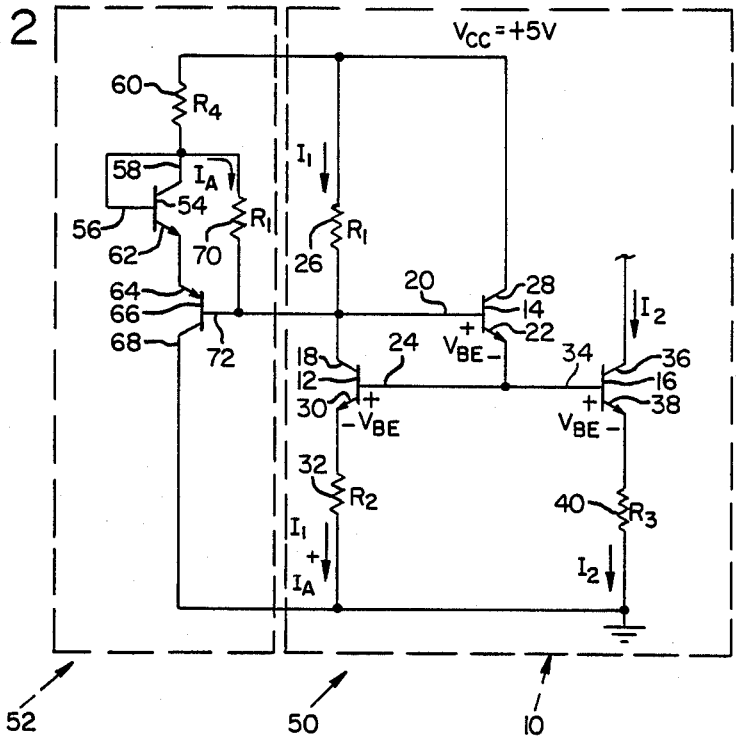
FIG. 2 is an electrical circuit diagram of a first preferred embodiment of the current source of the present invention.

With reference to FIG. 2, a current source 50 constitutes a first preferred embodiment of the present invention which includes the prior art current source 10 of FIG. 1 and a compensating circuit 52. Compensating circuit 52 develops a current $I_A$ which flows from collector terminal 18 to emitter terminal 30 of transistor 12 and reduces the dependence of the reference current $I_1$ on the base-to-emitter voltages of the transistors employed in current source 50.

Compensating circuit 52 includes a diode-connected NPN transistor 54 whose base terminal 56 and collector terminal 58 are connected to a resistor 60 of value "$R_4$" which is connected to $V_{CC}$. The emitter terminal 62 of transistor 54 is connected to the emitter terminal 64 of a PNP transistor 66 whose collector terminal 68 is connected to ground. Transistor 66 is preferably a substrate PNP transistor when current source 50 is implemented in integrated circuit form. A resistor 70 of value "$R_1$" is connected between the collector terminal 58 of transistor 54 and the base terminal 72 of transistor 66. The voltage drop across resistor 70 determines the value of the compensating current $I_A$, which flows through resistor 70. The value $R_4$ of resistor 60 is chosen so that the current flowing through resistor 60 is greater than $I_A$. Transistors 54 and 66 and resistor 60 are chosen to provide approximately the same base-to-emitter voltages, $V_{BE}$, as those of transistors 12, 14, and 16; therefore, the magnitude of the compensating current $I_A$ can be expressed as $2\times V_{BE}/R_1$. Since substantially all of the compensating current $I_A$ flows into collector terminal 18 of transistor 12, the total current flowing through resistor 32 equals the sum of $I_1+I_A$, which can be expressed as:

$$I_1+I_A=V_{CC}/(R_1+R_2)-2V_{BE}/R_12-V_{BE}/R_1=V_{CC}/(R_1+R_2).$$

The above equation shows that the total current $I_1+I_A$ flowing through resistor 32 is independent of $V_{BE}$. The output current $I_2$ can be expressed as:

$$I_2=(I_1+I_A)\times R_2/R_3=V_{CC}\times R_2/((R_1+R_2)\times R_3)$$

The above equation indicates that the output current $I_2$ of current source 50 is also independent of $V_{BE}$.

It will be appreciated that replacing transistor 54 with a short circuit conductor between resistor 60 and emitter terminal 64 of transistor 66 and changing the value of resistor 70 to $R_1/2$ provide the same reference current $I_1$ compensating current $I_A$, and output current $I_2$ as those calculated above.

Figure 3:
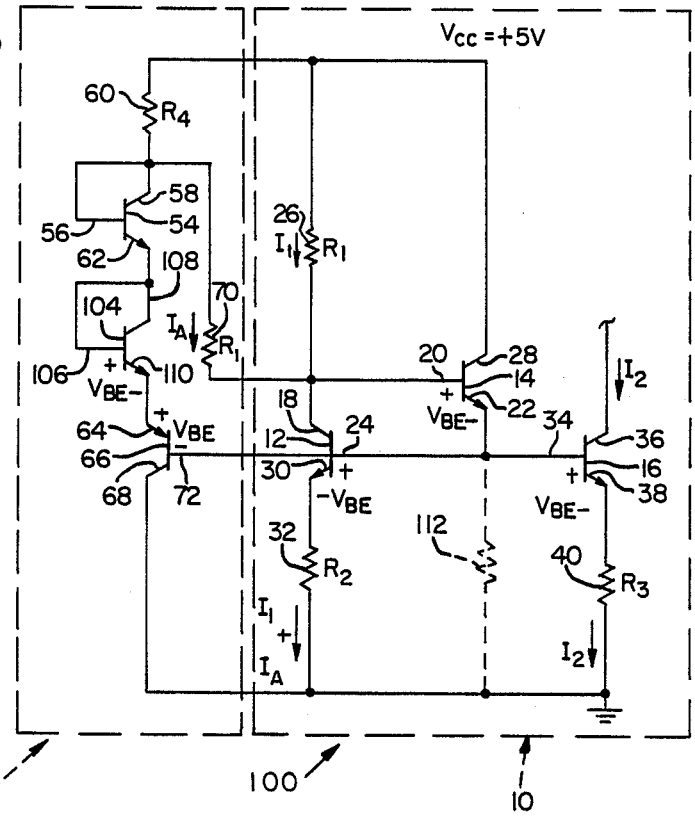
FIG. 3 is an electrical circuit diagram of a second preferred embodiment of the current source of the present invention.

With reference to FIG. 3, a current source 100 constitutes a second preferred embodiment of the present invention which includes the prior art current source 10 of FIG. 1 and a compensating circuit 102. Compensating circuit 102 develops a current $I_A$ which flows from collector terminal 18 to emitter terminal 30 of transistor 12 and reduces the dependence of the reference current $I_1$ on the base-to-emitter voltages of the transistors employed in current source 100. Compensating circuit 102 is identical with compensating circuit 52 of FIG. 2, with the exception that a diode-connected NPN transistor 104 is positioned between transistors 54 and 66.

The base terminal 106 and collector terminal 108 of transistor 104 is connected to emitter terminal 62 of transistor 54, and the emitter terminal 110 of transistor 104 is connected to emitter terminal 64 of transistor 66. The voltage drop across resistor 70 determines the value of the compensating current $I_A$, which flows through resistor 70. Transistor 104 and resistor 60 are chosen to provide approximately the same base-to-emitter voltage, $V_{BE}$, as those of transistors 12, 14, 16, 64, 66; therefore, the magnitude of the compensating current $I_A$ can be expressed as $2\times V_{BE}/R_1$. Since the currents $I_1$ and $I_A$ have the same values as those of the corresponding ones of current source 50 of FIG. 2, the output current $I_2$ flowing through resistor 40 has the same value as that derived above for current source 50. The output current $I_2$ is, therefore, independent of $V_{BE}$. A resistor 112 (shown in phantom) positioned between base terminal 34 of transistor 16 and ground may be necessary to provide a conduction path for a portion of the current flowing from base terminal 72 of transistor 66 to ensure such current does not exceed the sum of the currents flowing through base terminal 24 of transistor 12 and base terminal 34 of transistor 16.

Figure 4:
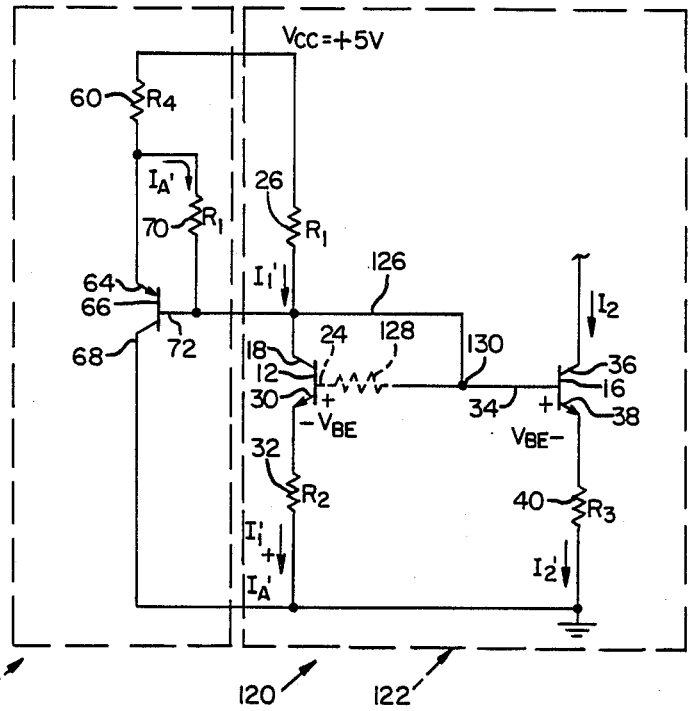
FIG. 4 is an electrical circuit diagram of a third preferred embodiment of the current source of the present invention.

With reference to FIG. 4, a current source 120 constitutes a third preferred embodiment of the present invention which includes a prior art current source 122 and a compensating circuit 104. Current source 122 is identical with current source 10 of FIG. 1, with the exception that a conductor 126, which provides a short circuit connection between collector terminal 18 and base terminal 24 of transistor 12, replaces transistor 14. An optional resistor 128 (shown in phantom) can be positioned between base terminal 24 of transistor 12 and a junction node 130 to compensate for $\beta_F$ dependence of transistors 12 and 16 on the output current $I_2$. The reference current $I_{1'}$ flowing through transistor 12 is determined by application of Kirchoff's voltage law and can be expressed as:

$$I_{1'}=V_{CC}/(R_1+R_2)-2V_{BE}/R_1.$$

The above equation is correct under the assumption that the collector and emitter currents of transistor 12 are equal. The output current $I_{2'}$ flowing through resistor 32 is determined by application of Kirchoff's voltage law and can be expressed as:

$$I_{2'}=I_{1'}\times R_2/R_3.$$

The above equation is correct under the assumptions that $\beta_F$ equals $\infty$ and the base-to-emitter voltages of transistors 12 and 16 are equal.

Compensating circuit 124 develops a current $I_{A'}$, which flows from collector terminal 18 to emitter terminal 30 of transistor 12 and offsets the dependence of current $I_{1'}$ on the base-to-emitter voltages of the transistors employed in current source 122. Compensating circuit 124 is identical with compensating circuit 52 of FIG. 2, with the exception that a short circuit replaces diode-connected transistor 104. The voltage across resistor 70 is the base-to-emitter voltage, $V_{BE}$, of transistor 66, which provides the compensating current $I_{A'}$ of value $V_{BE}/R_1$. Since substantially all of the compensating current $I_{A'}$ flows into collector terminal 18 of transistor 12, the current flowing through resistor 32 equals the sum of $I_{1'}+I_{A'}$, which can be expressed as:

$$I_{1'}+I_{A'}=V_{CC}/(R_1+R_2)-V_{BE}/R_1+-V_{BE}/R_1=V_{CC}/(R_1+R_2).$$

The above expression shows that the composite current $I_{1'}+I_{A'}$ has the same value as $I_1+I_A$ of FIG. 2. The reson is that the effect of removing transistor 14, which affects the value of $I_1$, offsets the effect of removing transistor 54, which affects the value of $I_A$. The output current $I_{2'}$ can be expressed as:

$$I_{2'}=(I_{1'}+I_{A'})\times R_2/R_3=V_{CC}\times R_2/((R_1+R_2)\times R_3).$$

The above expression indicates that the output current $I_{2'}$ of current source 120 is also independent of $V_{BE}$ and is the same as the output current $I_2$ of current source 50 of FIG. 2.

It will be appreciated that the three preferred embodiments described above can operate with the use of a single power supply having a magnitude as low as about 3 volts.

It will be obvious to those having skill in the art that many changes may be made in the above-described details of the preferred embodiments of the present invention without departing from the underlying principles thereof. The scope of the present invention should be determined, therefore, only by the following claims.

We claim:

1. A temperature compensated current source, comprising:

a current mirror circuit including first, second, and third transistors each having a base, a collector, and an emitter, the bases of the first and second transistors being coupled together and to the emitter of the third transistor, the emitters of the first and second transistors being coupled together and to a first source of reference voltage, the collector of the first transistor and the base of the third transistor being coupled together to form a current input, and the collector of the second transistor forming a current output;

a reference impedance coupled between a second source of reference voltage and the current input for establishing an input current; and compensating current means for injecting a compensating current into the collector of the first transistor such that the output current flowing in the collector of the second transistor is substantially temperature invariant.

2. A temperature compensated current source as in claim 1 wherein the value of the compensating current is substantially equal to two emitter base junction voltages divided by the resistance of said reference impedance.

3. A temperature compensated current source as in claim 1 further comprising an emitter resistor interposed between the emitter of the first transistor and the first source of reference voltage, and an emitter resistor interposed between the emitter of the second transistor and the first source of reference voltage.

4. A temperature compensated current source as in claim 1 wherein the compensating current means comprises a diode connected transistor having an anode and a cathode, a PNP transistor having a base, a collector and an emitter, and a current setting resistor, the anode of the diode connected transistor and one end of the current setting resistor being coupled together and to a source of bias current, the cathode of the diode connected transistor being coupled to the emitter of the PNP transistor, the base of the PNP transistor being coupled to the other end of the current setting resistor and to the current input of said current mirror circuit, and the collector of the PNP transistor being coupled to the first source of reference voltage.

5. A temperature compensated current source as in claim 4 wherein the value of the current setting resistor is substantially equal to the value of the reference impedance.

6. A temperature compensated current source as in claim 1 wherein the compensating current means comprises first and second diode connected transistors each having an anode and a cathode, a PNP transistor having a base, a collector, and an emitter, and a current setting resistor, the anode of the first diode connected transistor and one end of the current setting resistor being coupled together and to a source of bias current, the cathode of the first diode connected transistor being coupled to the anode of the second diode connected transistor, the cathode of the second diode connected transistor being coupled to the emitter of the PNP transistor, the other end of the current setting resistor being coupled to the current input of said current mirror circuit, the base of the PNP transistor being coupled to the base of the first transistor of said current mirror circuit, and the collector of the PNP transistor being coupled to the first source of reference voltage.

7. A temperature compensated current source as in claim 6 wherein the value of the current setting resistor is substantially equal to the value of the reference impedance.

8. A temperature compensated current source, comprising:

a current mirror circuit including first and second transistors each having a base, a collector, and an emitter, the bases of the first and second transistors being coupled together and to the collector of the first transistor to form a current input, the emitters of the first and second transistors being coupled together and to a first source of reference voltage, and the collector of the second transistor forming a current output;

a reference impedance coupled between a second source of reference voltage and the current input for establishing an input current; and compensating current means for injecting a compensating current into the collector of the first transistor such that the output current flowing in the collector of the second transistor is substantially temperature invariant.

9. A temperature compensated current source as in claim 8 wherein the value of the compensating current is substantially equal to an emitter base junction voltage divided by the resistance of said reference impedance.

10. A temperature compensated current source as in claim 8 further comprising an emitter resistor interposed between the emitter of the first transistor and the first source of reference voltage, and an emitter resistor interposed between the emitter of the second transistor and the first source of reference voltage.

11. A temperature compensated current source as in claim 8 wherein the compensating current means comprises a PNP transistor having a base, a collector, and an emitter, and a current setting resistor, the emitter of the PNP transistor being coupled to one end of the current setting resistor and to a source of bias current, the base of the PNP transistor being coupled to the other end of the current setting resistor and to the current input of said current mirror circuit, and the collector of the PNP transistor being coupled to the first source of reference voltage.

12. A temperature compensated current source as in claim 11 wherein the value of the current setting resistor is substantially equal to the value of the reference impedance.

* * * * *